US008032048B2

(12) United States Patent
Monde

(10) Patent No.: US 8,032,048 B2
(45) Date of Patent: Oct. 4, 2011

(54) IMAGE FORMING APPARATUS WITH STANDBY AND POWER SAVING MODES

(75) Inventor: Masafumi Monde, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 749 days.

(21) Appl. No.: 12/114,243

(22) Filed: May 2, 2008

(65) Prior Publication Data

US 2008/0279578 A1 Nov. 13, 2008

(30) Foreign Application Priority Data

May 8, 2007 (JP) ..... 2007-123221

(51) Int. Cl.
*G03G 15/20* (2006.01)

(52) U.S. Cl. ..... 399/70; 399/88

(58) Field of Classification Search ..... 399/67, 399/69, 70, 75, 81, 82, 85, 88
See application file for complete search history.

(56) References Cited

U.S. PATENT DOCUMENTS 7,120,371 B2 * 10/2006 Fujimori ..... 399/67
7,706,709 B2 * 4/2010 Okamoto et al. ..... 399/70
7,756,434 B2 * 7/2010 Murata ..... 399/70

FOREIGN PATENT DOCUMENTS

JP 5-323710 12/1993

* cited by examiner

*Primary Examiner* — William J Royer
(74) *Attorney, Agent, or Firm* — Fitzpatrick, Cella, Harper & Scinto

(57) ABSTRACT

An image forming apparatus, for which a heated roller fixing device is employed but for which a savings in power can still be obtained, is provided. The image forming apparatus includes: a fixing device, which is a heated roller fixing device that requires pre-heating in a stand-by state; an operation panel, with which a power-saving mode transition time period can be changed; and a control part, which selects pre-heating or does not select pre-heating of the heated roller fixing device. The control part employs the power-saving mode transition time period, entered at the operation panel, to change the pre-heating or to not change the pre-heating of the heated roller fixing device.

3 Claims, 6 Drawing Sheets

FIG. 4A CONDITION

FIG. 4B POWER

FIG. 4C TEMPERATURE OF FIXING DEVICE

FIG. 4D PRE-HEAT OF FIXING DEVICE

FIG. 5A CONDITION

FIG. 5B POWER

FIG. 5C TEMPERATURE OF FIXING DEVICE

FIG. 5D PRE-HEAT OF FIXING DEVICE

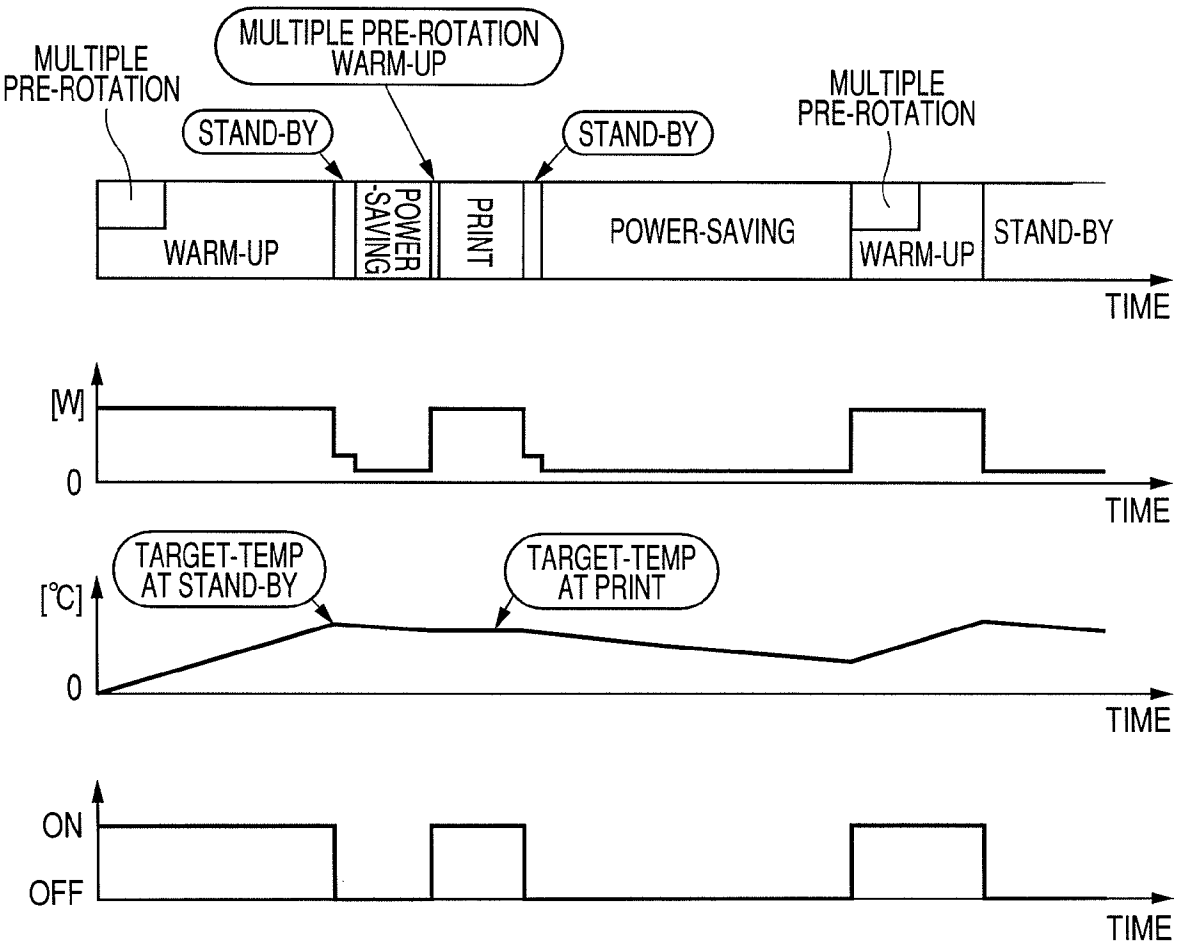
FIG. 7A CONDITION
FIG. 7B POWER
FIG. 7C TEMPERATURE OF FIXING DEVICE
FIG. 7D PRE-HEAT OF FIXING DEVICE

IMAGE FORMING APPARATUS WITH STANDBY AND POWER SAVING MODES

BACKGROUND OF THE INVENTION

1. Field of the Invention

The present invention relates to an image forming apparatus, such as a copier, a printer, a facsimile machine or a multifunctional apparatus that provides the function of each of these apparatuses, and relates particularly to a power-saving technology, for an image forming apparatus, that performs a pre-heating function in a stand-by state.

2. Description of the Related Art

An improvement in image quality, an increase in printing speed and a reduction in the time required for the first recording material to be output are features generally sought in image forming apparatuses, such as electrophotographic printers, copiers and facsimile machines. Further, on the market, added values, such as extension for optional functions and a power-saving method, are now in greater demand than previously. And especially, with regards to a power-saving method, an internationally recognized power-saving program, such as the Energy Star or the Blue Angel, is adapted for electric apparatuses. Furthermore, during the production of image forming apparatuses, environmental problems are actively taken into consideration.

An image forming apparatus includes a toner fixing device, which applies heat to melt the toner in an unfixed toner image, formed on a recording sheet or an OHP sheet, to fuse the toner to the sheet and to produce a permanent, fixed image.

Of the various types of image forming apparatuses available, there are some for which fixing devices should be warmed up (pre-heated) while such apparatuses are on printing stand-by. These types include, for example, full color printers, wherein rubber layers are formed on fixing devices used to fix toner images, and fast printers, which produce a large number of prints per unit time. Since the fixing device of such an apparatus has a large heat capacity, the fixing device is warmed up during the printing stand-by state of the image forming apparatus, thereby reducing the period required to output a recording material bearing a toner image.

The most effective power-saving method for an image forming apparatus is one that reduces the power consumed during the printing stand-by state of the image forming apparatus. Normally, printing is seldom performed continuously, throughout a day, and during a day, the image forming apparatus normally remains in the stand-by state rather longer than in the printing state. Therefore, reducing the power consumed during the stand-by state is the most effective method by which to reduce cumulative power consumption (effectively reduces the cumulative power consumption [W·h]: Watt Hours). Generally, the electric power required to pre-heat a fixing device (electric power consumed per unit time) accounts for 90% or greater of the total power consumed by a printer in the stand-by state (power consumed per unit time). Therefore, when the power consumed by the fixing device during each printing stand-by period is effectively reduced, the overall affect produced is a reduction in the cumulative power consumed.

On the other hand, power savings can be provided by simply not performing the pre-heating of the fixing device during stand-by periods, and the economic merit afforded by the power thus saved will accrue to a user. However, the warm-up period required to reach a fixing temperature would be extended, and usability would deteriorate.

Therefore, according to one proposal, provided in Japanese Patent Application Laid-Open No. H05-323710, a user can set a transition period from the end of printing to the power-saving mode. Currently, however, a demand exists for an improved system.

SUMMARY OF THE INVENTION

A purpose of the present invention is to provide an image forming apparatus which can be set up in accordance with user's preferences, and for which power saving can be obtained with a simple setup, to address the above problems.

Another purpose of the present invention is to provide an image forming apparatus including an image forming part adapted to form an image on a recording material, a heat fixing part including a heat source configured to generate heat from electrical power, for fixing the image formed on the recording material, and a controller configured to control the operation of the heat fixing part, wherein, the image forming apparatus is operable to transfer from a stand-by mode to a power-saving mode in which the electric power consumed by the image forming apparatus is smaller than the electric power consumed by the image forming apparatus in the stand-by mode, if the image forming apparatus does not receive a print job in the stand-by mode in a set time period, and the image forming apparatus further includes a time period setting part configured to permit a user to set a time period for transferring to the power-saving mode, wherein, if the time period set by the user using the time period setting part is shorter than a reference period, the heat source is controlled to consume an average electric power in the stand-by mode which is smaller than the average electric power consumed if the time period set by the user is longer than said reference period.

A further purpose of the present invention is to provide a method of reducing the power consumed by an image forming apparatus having a standby mode and a power saving mode which uses less power than the standby mode, the method including, controlling the apparatus to enter the standby mode after switch on or after a job has been printed, providing a predetermined threshold time period after which the apparatus is controlled to enter the power saving mode from the standby mode, permitting a user to set a user defined mode transfer time period, including the user defined mode transfer period with the predetermined threshold time period, and if the user defined mode transfer period is shorter than the predetermined threshold time period, controlling the image forming apparatus to consume less power in the standby mode.

A still further purpose of the present invention will become apparent from the following description of exemplary embodiments with reference to the attached drawings.

when the power-saving mode transition time period T is equal to or shorter than a threshold period X, according to the first embodiment.

Figure 4:
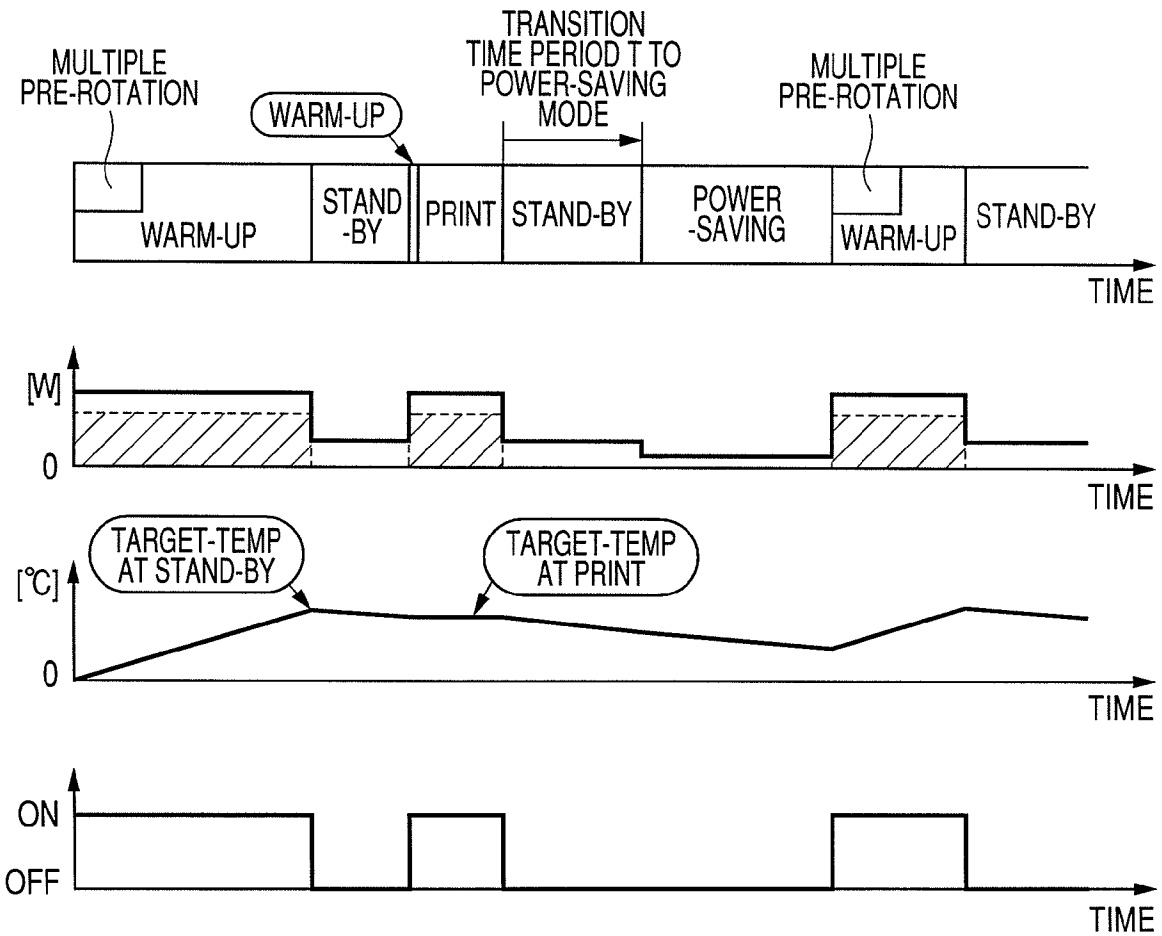
FIG. 4A is a diagram illustrating a time-transient change in the state of the laser beam printer (image forming apparatus)

FIG. 4B is a diagram illustrating a time-transient power change in the laser beam printer (image forming apparatus) when the power-saving mode transition time period T is equal to or shorter than the threshold period X, according to the first embodiment.

FIG. 4C is a diagram illustrating a time-transient temperature change for the fixing device when the power-saving mode transition time period T is equal to or shorter than the threshold period X, according to the first embodiment.

FIG. 4D is a diagram illustrating a time-transient change in the pre-heating ON and OFF states of the fixing device when the power-saving mode transition time period T is equal to or smaller than the threshold period X, according to the first embodiment.

Figure 5:
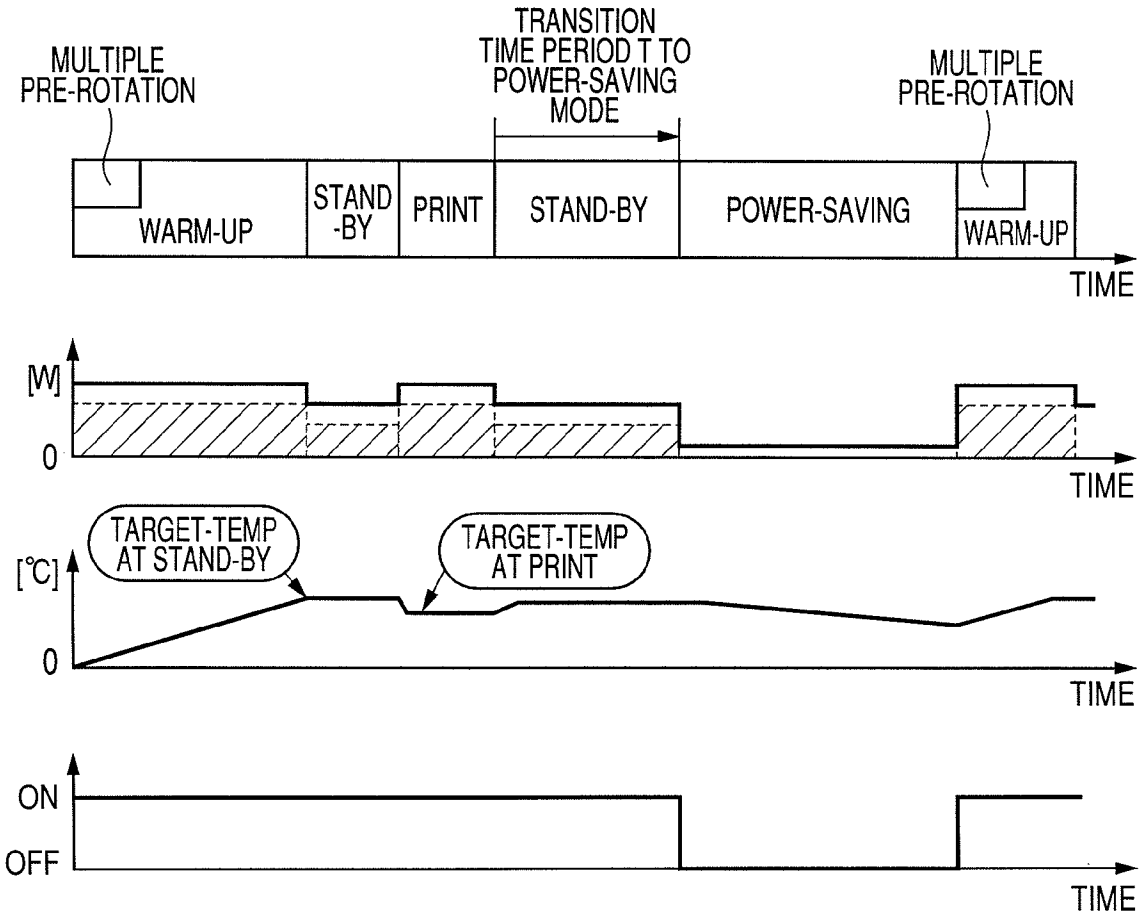

FIG. 5A is a diagram illustrating a time-transient temperature change in the laser beam printer (image forming apparatus) when "the power-saving mode transition time period T is longer than the threshold period X", according to the first embodiment.

FIG. 5B is a diagram illustrating a time-transient power change in the laser beam printer (image forming apparatus) when "the power-saving mode transition time period T is longer than the threshold period X", according to the first embodiment.

FIG. 5C is a diagram illustrating a time-transient temperature change for the fixing device when "the power-saving mode transition time period T is longer than the threshold period X", according to the first embodiment.

FIG. 5D is a diagram illustrating a time-transient change in the pre-heating ON and OFF states of the fixing device when "the power-saving mode transition time period T is longer than the threshold period X", according to the first embodiment.

Figure 6:
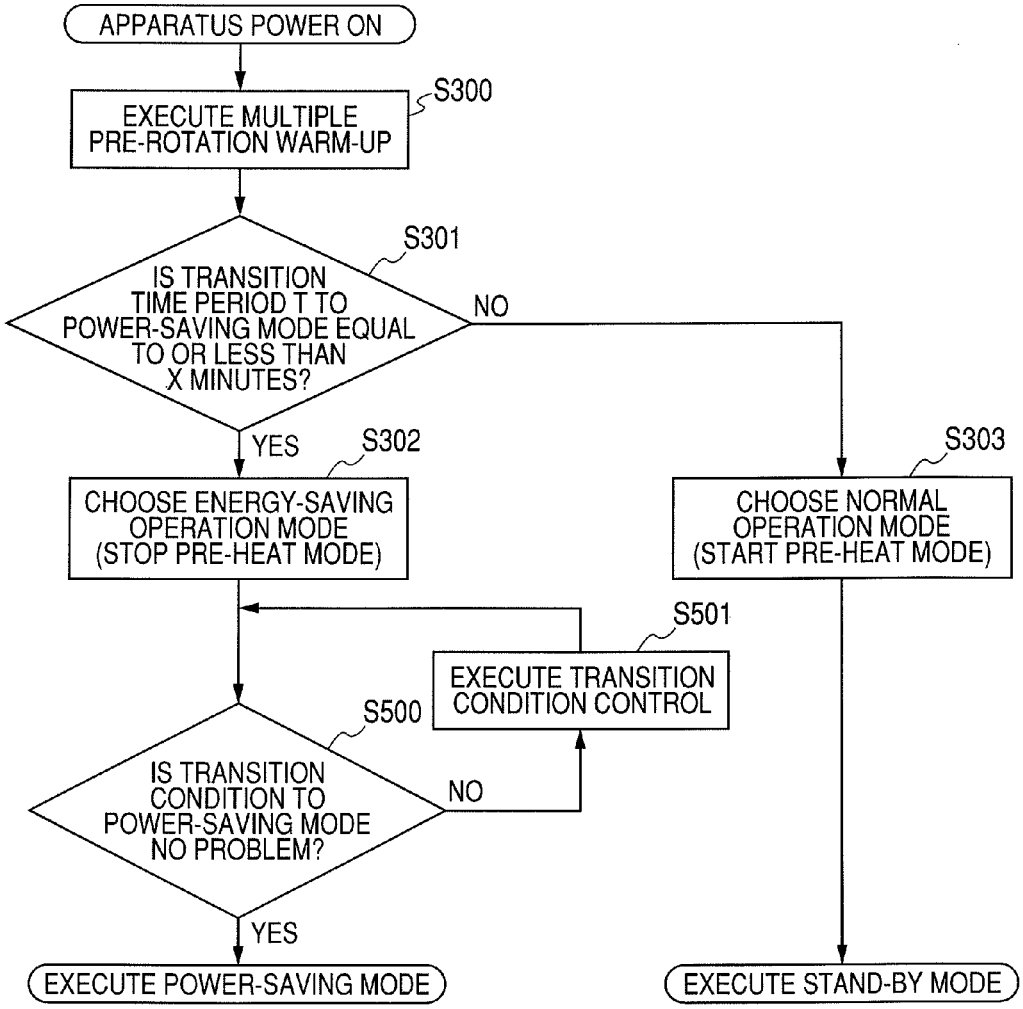

FIG. 6 is a flowchart for explaining the processing, according to a second embodiment of the present invention, for reducing the printing stand-by period when the power-saving mode is selected in the stand-by state.

FIG. 7A is a diagram illustrating a time-transient change in the state of a laser beam printer (image forming apparatus) when a printing stand-by period is reduced, according to the second embodiment.

FIG. 7B is a diagram illustrating a time-transient power change in the laser beam printer (image forming apparatus) when the printing stand-by period is reduced, according to the second embodiment.

FIG. 7C is a diagram illustrating a time-transient temperature change for a fixing device when the printing stand-by period is reduced, according to the second embodiment.

FIG. 7D is a diagram illustrating a time-transient change in the pre-heating ON and OFF states of the fixing device when the printing stand-by period is reduced, according to the second embodiment.

DESCRIPTION OF THE EMBODIMENTS

Figure 1:
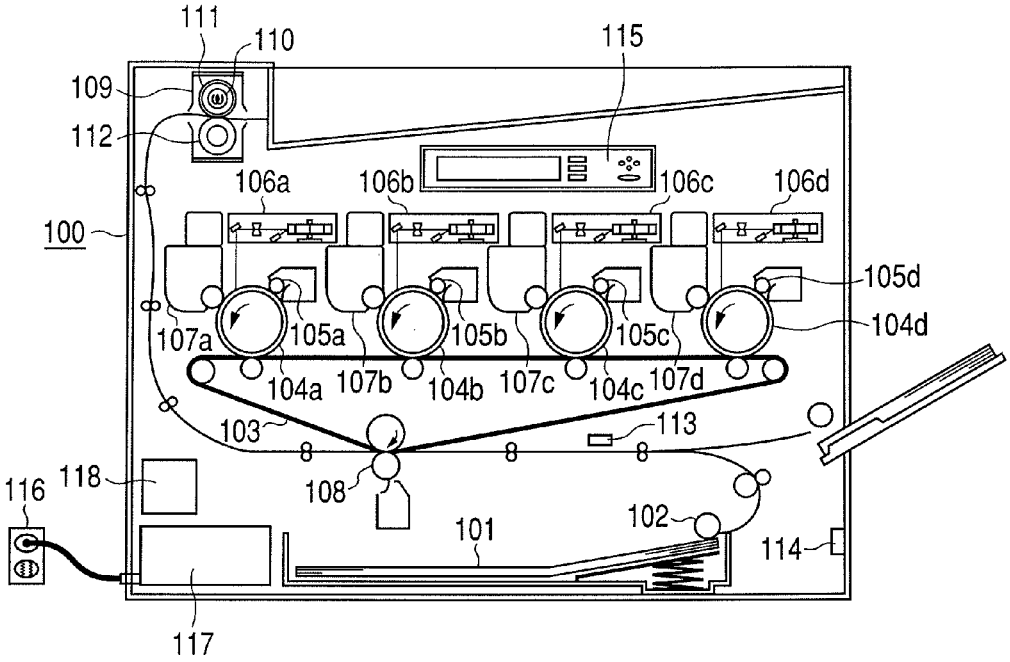
FIG. 1 is a schematic vertical cross sectional view of a laser beam printer, which is an example of an image forming apparatus according to the present invention.

Exemplary embodiments of the present invention will now be described in detail while referring to the accompanying drawings. In the following embodiments, a laser beam printer illustrated in FIG. 1 is employed as an example. However, the present invention can, in general, be applied for any image forming apparatus that employs an electrophotographic process (electrophotographic system), and is not especially limited to a laser beam printer.

First Embodiment

FIG. 1 is a vertical cross sectional view of an example schematic arrangement for a laser beam printer, which is an example image forming apparatus, according to a first embodiment of the present invention. As illustrated in FIG. 1, in a laser beam printer 100, a recording material (recording member) 101 is fed by a feeding roller 102, and is conveyed to an intermediate transfer belt (intermediate transfer member) 103.

Photosensitive drums (image bearing members) 104*a*, 104*b*, 104*c* and 104*d* are rotated counterclockwise, at a predetermined speed, by the driving forces of drive motors (not shown), and while rotating, are uniformly electrically charged by primary charging devices 105*a*, 105*b*, 105*c* and 105*d*. In this embodiment, the letters a, b, c and d correspond respectively to yellow, magenta, cyan and black. The laser beam printer 100 in FIG. 1 represents a full-color image forming apparatus; however, a monochrome image forming apparatus may be employed as an alternative.

Laser beams are modulated in accordance with image signals, and are output by laser beam scanners 106*a*, 106*b*, 106*c* and 106*d* (hereinafter, the letters a to d are omitted and each scanner is referred to simply as laser beam scanner 106). The photosensitive drums (image bearing members) 104*a*-104*d* are selectively exposed and scanned by the laser beams to form electrostatic latent images on them.

Developing devices 107*a*-107*d* attach toner powder, which is a developer, to the electrostatic latent images to obtain visible toner images (developed images). The toner images formed on the photosensitive drums 104*a*-104*d* are initially transferred to the intermediate transfer belt 103, which contacts the photosensitive drums 104*a*-104*d* while being rotated. Thereafter, the recording material 101 is conveyed at an appropriate speed, synchronized with the rotation of the intermediate transfer belt 103, and is pressed against the intermediate transfer belt 103 by transfer roller 108, to which a transfer bias potential has been applied. As a result, the toner images are secondarily transferred to the recording material 101.

According to this arrangement, since a photosensitive drum 104, a primary charging device 105, a laser beam scanner 106 and a developing device 107 is provided for each of four colors, i.e., yellow, magenta, cyan and black, a four color toner image is secondarily transferred to the recording material 101. The photosensitive drums 104, the charging devices 105, the scanners 106, the developing devices 107 and the transfer roller 108 constitute the image forming part.

A fixing device (a heat fixing part) 109 that fixes an image to a recording material includes: a fixing roller 111 that incorporates a fixing heater 110; and a pressure roller 112 that presses against the fixing roller 111. The fixing device 109 fixes a toner image by heating and pressing the recording material 101, and discharges from the laser beam printer 100 (outside the apparatus) the resultant recording material as an image bearing material (e.g., printed matter). For this arrangement, a halogen heater or an electromagnetic heater is employed as the fixing heater (a heat source that generates heat when rendered conductive) 110. This kind of fixing device is generally called a heated roller fixing device.

A media sensor 113 determines the type of recording material 101, i.e., determines, prior to the secondary transfer process, whether the recording material 101 that is fed is a paper sheet or a resin sheet. An environment sensor 114 is a sensor for detecting the temperature and humidity inside the laser beam printer 100.

An operation panel (a user setup part or a part of a mode transition time period setting part) 115 is a section that provides an apparatus status alarm for a user, or that permits a user to enter setup data for the apparatus. Operation switches and an LED display device are provided on the operation panel 115 and are employed by a user to set a period during which the operation mode is to be transitioned to a power-saving mode that will be described later.

A power supply device 117, connected to an AC power source 116, includes: a circuit for supplying a fixing current to the fixing device 109; and a circuit for rectifying an alternating current to obtain a direct current. The power required for the above described process is supplied by the power supply device 117, which is the main power source for the individual sections of the laser beam printer 100. Further, another function of the fixing current supply circuit is the switching on and off of the fixing heater 110, which is used to adjust the temperature of the fixing device 109.

A control part (control means) 118 controls the entire operation of the laser beam printer 100, and includes circuits such as a CPU, a RAM and a ROM. In accordance with a control program stored in the ROM, the control part 118 performs various control processes for the laser beam printer 100 using signal control lines (not shown). Furthermore, the control part 118 changes the control processes for of the laser beam printer 100 in accordance with setup data entered at the operation panel 115. When the laser beam printer 100 is connected to a personal computer (PC) via a network or a printer cable, the control part 118 can perform control processes in accordance with the setup for the printer driver of the PC. That is, the control part 118 also serves as the mode transition time period setting part. When only the printer driver of the PC can be employed to set a saving-mode transition time period, the control part 118 serves as a mode transition time period setting part. As described above, the laser beam printer 100 includes the mode transition time period setting part that permits a user to set a period during or after which the operation mode is to be transitioned to a power-saving mode.

The printing processing performed by the laser beam printer 100 has been described. Next, the processing will be described that is performed when the laser beam printer 100 is powered on and is to be transitioned to the power-saving mode.

When the laser beam printer 100 is powered on, the normal operation of a loading part is examined by performing multiple pre-rotations (preparatory rotations to obtain the image forming enabled state), while at the same time, the fixing device 109 is warmed up in order to set the laser beam printer 100 in the printing stand-by state to wait for a print job. When the laser beam printer 100 receives a print job before the warm-up process has ended, at which point the laser beam printer 100 transits to the stand-by state, the printing operation is performed after the warm-up process is completed. When no print job is received, or when a printing operation has been completed, the laser beam printer 100 is transitioned to the stand-by state. The printing stand-by state is a state in which, within a short period of time, the image forming process for a print job can be started without carrying out the multiple pre-rotations. The laser beam printer 100 is normally maintained in the stand-by state, and upon receiving a print job from a user while in stand-by, the laser beam printer 100 can immediately perform the printing operation. When a heated roller fixing device is employed as the fixing device 109, the fixing device 109 is pre-heated during the stand-by period. For the laser beam printer 100 in this embodiment, a target temperature for controlling the fixing roller 111 in the stand-by period is set higher than the target control temperature during printing. However, the target temperature for controlling the fixing roller 111 during the stand-by period may be the same as that during printing, or may be lower than that, and an appropriate temperature can be designated.

Figure 2:
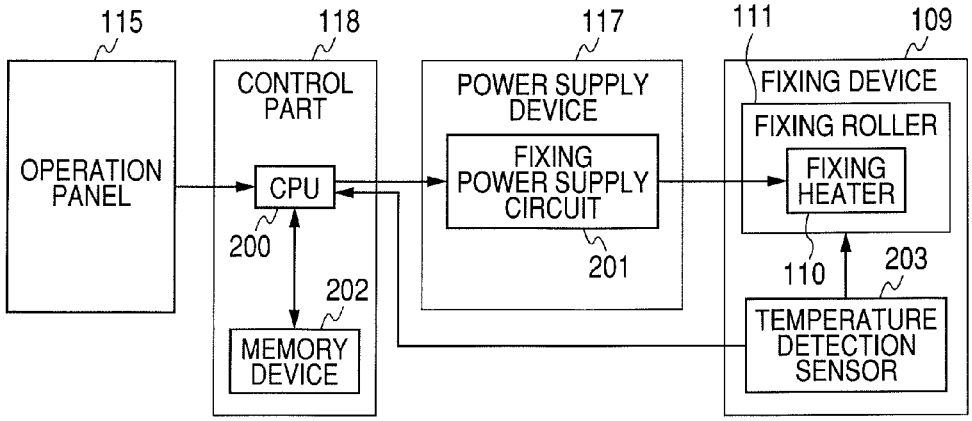
FIG. 2 is a block diagram for explaining pre-heating control for a the fixing device of the image forming apparatus of the present invention.

An example pre-heating process is illustrated in FIG. 2. FIG. 2 is a block diagram for describing the pre-heating process for the fixing device 109 of the laser beam printer 100 according to the first embodiment. In the laser beam printer 100, a CPU 200 of the control part 118 controls a fixing power supply circuit 201 of the power supply device 117, and turns on or off the fixing heater 110 to adjust the temperature of the fixing roller 111. In accordance with a target temperature that is stored in a memory device 202, such as a ROM, and the roller surface temperature of the fixing roller 111 that is detected by a temperature detection sensor (temperature detection means) 203, the CPU 200 controls the fixing power supply circuit 201 so as to maintain a constant roller surface temperature. An arbitrary temperature detection sensor (temperature detection means) that detects or senses the surface temperature of the fixing roller is available, and a thermistor, a temperature coefficient resistor or a thermopile of either a contact type or a non-contact type can be employed. Furthermore, in this embodiment, a temperature detection sensor (temperature detection means) is arranged in the fixing device 109; however, the arrangement of the temperature detection sensor arrangement is not limited to the interior of the fixing device 109.

In addition, as well as an international program that has an environmentally friendly aspect, such as the Energy Star or the Blue Angel certification, for an electric apparatus, the laser beam printer 100 has a function for gradually transitioning to a power-saving mode while taking environmental protection into account. That is, when a print job is not received while in the stand-by mode, the laser beam printer 100 is transitioned from the stand-by mode to the power-saving mode, during which the electric power (unit: W) consumed by the entire apparatus (the entire printer) is lower than in the stand-by mode. The power-saving mode transition time period T can be set by a user using the operation panel 115. Various transition time periods can be set by the user, e.g., 1 minute, 5 minutes, 15 minutes, 30 minutes, 60 minutes, 90 minutes or 120 minutes, and generally, the initial time is set so as to conform with the above described international program guidelines. When the user employs an apparatus that is equipped with a power-saving system, the user generally changes the power-saving transition time period, since this is the easiest and most familiar change means the user can employ. The power-saving mode is the operation mode in which the least power is consumed by the laser beam printer 100, and in the power-saving mode, the fixing device 109, which is a load part of the power supply device 117, is powered off, and operation of another drive load source, such as a fan motor, is halted, and the load imposed on the power supply device 117 is reduced. That is, the electric power (unit: W) consumed by the entire apparatus (the entire printer) is lower in the power-saving mode than in the stand-by mode.

Figure 3:
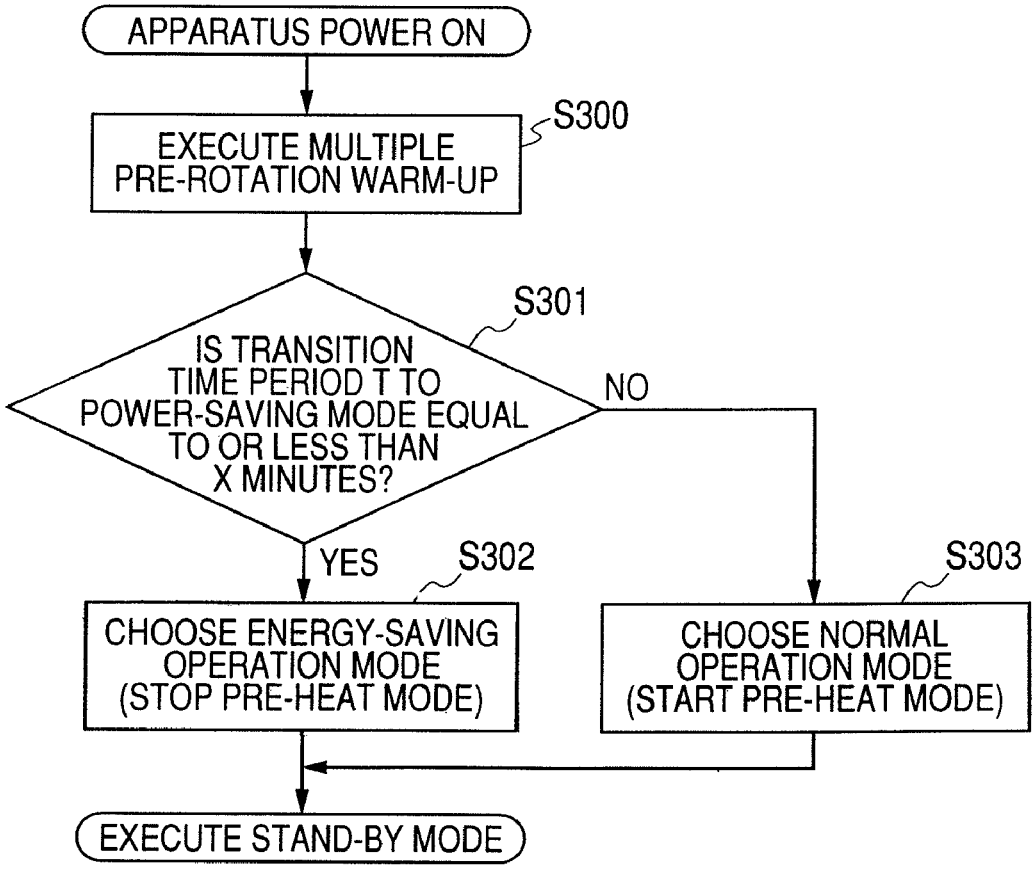
FIG. 3 is a flowchart for explaining the processing for changing pre-heating control, during printing stand-by, in accordance with a power-saving mode transition time period T, according to a first embodiment of the present invention.

FIG. 3 is a flowchart that most appropriately depicts the feature of the present invention and describes the processing performed in this embodiment, in which pre-heating control of the fixing device during a stand-by period (in the stand-by mode) is selected in accordance with the setup for the power-saving mode transition time period T. Assume, in this instance, that this processing is to be initiated immediately after the power switch of the laser beam printer 100 (referred to as the apparatus in FIG. 3) is turned on. However, this is merely an example. At step S300, as a checkup operation, the control part 118 permits the apparatus load parts to perform multiple pre-rotations. The process of the multiple pre-rotations is an operation performed to determine whether almost all load parts included in the laser beam printer 100 are operating normally. At the same time, at step S300, the warm-up process is performed for the fixing device 109 to set the laser beam printer 100 into the printing stand-by state. When the laser beam printer 100 does not receive a print job during the multiple pre-rotations or the warm-up process at step S300, or when, in a case wherein the laser beam printer 100 received a print job and the printing for the job has been completed, the laser beam printer 100 is transitioned to the printing stand-by state. The printing stand-by state is the state in which a print job can be started within a short period of time, and generally, the laser beam printer 100 is maintained in the stand-by state. Therefore, upon receiving a print job from a user while in the stand-by state, the laser beam printer 100 can immediately perform the printing operation.

Next, a description will be given for whether the fixing device 109 has been pre-heated when the laser beam printer 100 is to be transitioned to the printing stand-by state. When a heated roller fixing device is employed as the fixing device 109, the fixing device 109 is pre-heated during the printing stand-by period. Assume that, using the operation panel 115, five minutes has been entered as the power-saving mode transition time period T, and X minutes is a threshold value to use for a determination (a reference time period). As illustrated in FIG. 2, the threshold value X is stored in the memory device 202, such as the ROM, of the control part 118, and the CPU 200 of the control part 118 performs the determination in the following manner, employing the power-saving mode transition time period T, entered at the operation panel 115, and the threshold value X.

When the power-saving mode transition time period T is shorter than the threshold period X at step S301 (Y: step S301), program control advances to a process in which pre-heating of the fixing device 109 is not to be performed when the laser beam printer 100 is transitioned to the stand-by state (step S302)(in FIG. 3, "choose power energy saving operation mode). The CPU 200 permits the fixing power supply circuit 201 of the power supply device 117 to turn off the fixing heater 110 of the fixing device 109, so that the process that inhibits pre-heating (in FIG. 3, "stop pre-heat mode") can be performed. When a user sets a short power-saving mode transition time period T, such as five minutes, it is regarded in many cases that, after the current print job has been completed, the user either intends to immediately perform another print job, or will not perform a print job for a while. Further, when a user sets a short power-saving mode transition time period T for the purpose of reducing the power consumption, pre-heating of the fixing device 109 during the stand-by period does not fit to the user's purpose, and rather becomes a defect. As one of the features of the laser beam printer 100, since a heated roller fixing device is provided as the fixing device 109, the heat capacity of the fixing device 109 is considerably greater than that of a film fixing device. Therefore, even when the fixing device 109 is not pre-heated, the temperature of the fixing device 109 falls little in merely about five minutes. As a result, when a user again transmits a print job to the laser beam printer 100 where the condition is such that the fixing device 109 is not pre-heated in the stand-by state and before a transition time period of five minutes has elapsed, the user is not inconvenienced.

On the other hand, when, at step S301, the power-saving mode transition time period T is set longer than the threshold period X (N: at step S301), program control is transitioned to the process for performing pre-heating when the apparatus is transitioned to the stand-by state (step S303) (in FIG. 3, "choose normal operation mode"). When a user sets a power-saving mode transition time period T of 15 minutes, for example, it is assumed in many cases that, after the current job has been completed, the user will perform another print job within 15 minutes, or will not perform a print job for a while after 15 minutes has elapsed. Assume that the heated roller fixing device is in the stand-by state for the maximum 15 minutes without being pre-heated. When such a fixing device 109 is thereafter employed to initiate a print job, the temperature of the fixing device 109 will have dropped much and a warm-up period is so long that the user can not ignore it. Therefore, the pre-heating control ("start pre-heat mode") should be selected.

As described above, based on the power-saving mode transition time period T (step S301), the energy-saving operation mode (step S302) or the normal operation mode (step S303) is selected, and the stand-by mode is entered. That is, when the time period T entered using the mode transition time period setting part is shorter than the reference period X, the average electric power consumed by the fixing heater 110 in the stand-by mode is smaller than when the time period T is longer than the reference period X. In this embodiment, when the time period T set using the mode transition time period setting part is shorter than the reference period X, no electric power is consumed by the fixing heater 110 while in the stand-by mode. However, instead of completely no power being consumed by the fixing heater 110, low power consumption by the fixing heater 110 is possible by setting the target temperature for the fixing roller 111 in the energy-saving operation mode lower than the target temperature in the normal operation mode. Further, without providing a target temperature, a fixed supply of electric power may be supplied so that the electric power consumed by the fixing heater 110 in the energy-saving operation mode is lower than that in the normal operation mode.

With this arrangement, an image forming apparatus can be provided wherein the user can set up the mode transition period as preferred, and power savings can be obtained with a simple setup.

It should be noted that when the supply of a current to the fixing heater 110 is controlled to maintain the target temperature of the fixing roller 111, the fixing heater 110 is turned on or off. That is, the power consumed by the fixing heater 110 in the normal operation mode varies, depending on the time. Therefore, the electric power when the pre-heat mode is started (i.e., normal operation mode) and when the pre-heat mode is stopped (i.e., energy-saving operation mode) is compared using an average value [W] (=accumulated electric power in the stand-by mode [Wh: Watt Hour]÷the stand-by mode period [h: Hour]). The comparison between the power consumed by the entire printer in the stand-by mode and the power consumed by the printer in the power-saving mode is also performed using the above described average value.

FIGS. 4A to 4D and FIGS. 5A to 5D are diagrams for describing the relationship of the performance of the pre-heating process for the fixing device 109 in the printing stand-by state, the change in the temperature of the fixing device 109 and the warm-up period. The relationship in FIGS. 4A to 4D represents a case wherein the processing advances to step S302 in FIG. 3, i.e., the laser beam printer 100 is transitioned to the energy-saving operation mode (the pre-heat mode is stopped). The relationship in FIGS. 5A to 5D represents a case wherein the processing is transited to step S303 in FIG. 3, i.e., the laser beam printer 100 is transitioned to the normal operation mode (the pre-heat mode is started). FIGS. 4A and 5A are diagrams illustrating a time-transient change in the state of the laser beam printer (apparatus) 100. FIGS. 4B and 5B are diagrams illustrating a time-transient change in the electric power ([W]) for the laser beam printer (apparatus) 100, the hatched portions indicate the power consumed by the fixing heater 110. FIGS. 4C and 5C are diagrams illustrating a time-transient change in the temperature ([° C.]) of the fixing device 109. FIGS. 4D and 5D are diagrams illustrating a time-transient change in the pre-heat ON and OFF periods for the fixing device 109. As is apparent from the comparison of FIGS. 4A to 4D and FIGS. 5A to 5D, when the time period T is set shorter than the reference period X, the electric power consumed by the fixing heater 110 in the stand-by mode is zero (FIG. 4B). And when the time period T is set longer than the reference period X, some electric power is consumed by the fixing heater 110 in the stand-by state (FIG. 5B).

As described above, since a heated roller fixing device having a great heat capacity is employed as the fixing device 109, once the fixing device 109 is heated to a predetermined temperature, the fixing device 109 is not easily cooled, even though the supply of electric power to the fixing heater 110 is halted (see FIGS. 4C and 5C). Further, an adjusted temperature value for the fixing device 109 in the pre-heat mode (in FIGS. 4A to 4D and FIGS. 5A to 5D, "target-temp at stand-by") is set higher than an adjusted temperature value for the fixing device 109 during the printing operation (in FIGS. 4A to 4D and FIGS. 5A to 5D, "target-temp at print"). A difference in the two temperatures may be 10° C. or more. Then, a temperature drop time period for the fixing device 109 that was not pre-heated and a temperature rise time period for the fixing device 109 that was pre-heated, and the adjusted temperature value for the printing operation are employed to select a threshold value, which is used to determine whether pre-heating of the fixing device 109 was performed.

It is also found that by performing the process at step S302, the electric power consumed by the entire apparatus is reduced in the printing stand-by state (in comparison with the electric power consumed in the stand-by states in FIGS. 4B and 5B).

In addition, the performance of pre-heating for the fixing device 109 changes the rise in the temperature inside the image forming apparatus (hereinafter referred to as in the apparatus). When pre-heating is not performed, continuous heat generation by the fixing heater 110 is halted, and the temperature rise in the apparatus is lowered, compared with when pre-heating is performed. Therefore, for the apparatus wherein a fan (not shown) that provides forced-air cooling, for example, is arranged in order to prevent the melting of toner powder or to maintain the rated temperature of the electronic parts, operation of the fan is not started, and more power can be saved. That is, when pre-heating of the fixing device 109 is not required, the number of forced-air cooling devices and the length of a cooling period or the number of fan rotations are reduced, and an increased reduction in power consumption obtained.

Second Embodiment

For a second embodiment of the present invention, since the arrangement of the image forming apparatus is the same as that for the first embodiment, no further description for this will be given, and the reference numerals used in the first embodiment are also employed in the second embodiment. The processing for the second embodiment will now be described while referring to the flowchart in FIG. 6. During the processing, a period for a printing stand-by state is to be shortened when an energy-saving operation mode is selected. According to the first embodiment, even an apparatus wherein a heated roller fixing device that requires pre-heating is arranged, the processing as preferred by the user is performed. That is, in the first embodiment, the pre-heat OFF state, wherein the energy-saving operation was performed in the stand-by state or in the pre-heat ON state and wherein the operation was performed while taking the warm-up period into account, was selected in consonance with the power-saving mode transition time period T, which was set by the user, and the pre-heat control was performed as preferred by the user. In the case where a time period set by a user for transferring to the power-saving mode is short, because a time period of a fan to cool a temperature in an apparatus becomes short, the mode of the apparatus may transfer to the power-saving mode without cooling the inside of the apparatus. The fan is enabled in stand-by mode, while it is disabled in the power-saving mode. In the second embodiment, in the case where a time period set by a user for transferring to the power-saving mode is short, the mode of the apparatus is transferred to the power-saving mode after the condition of the apparatus satisfies with the predetermined condition, e.g. the temperature in the apparatus is less than the predetermined temperature.

Since the processing from the time the power is turned on in FIG. 6 to steps S302 and S303 is the same as that in the first embodiment, no further description of this will be given. Furthermore, since the processing following step S303, at which the pre-heating process is selected, is the same as that in the first embodiment, no further description for this will be given.

When program control advances to step S302, whereat pre-heat control is not to be performed, a check is performed to determine whether a power-saving mode transition condition, such as a temperature rise in the apparatus, has been established (step S500). The power-saving mode transition condition is not limited only to control of the temperature rise in the apparatus, but also includes control of the discharge of a volatile organic compound, i.e., includes all the conditions that ensure product quality is assured, without any problems being encountered when the laser beam printer 100 is transitioned to the power-saving mode. For example, the condition in which the predetermined temperature rise in the apparatus is satisfactory, or in which the predetermined amount of volatile organic compounds discharged is satisfactory.

When the power-saving mode transition condition is not satisfied at step S500 (N: step S500), at step S501 a transition condition control process, such as the control process for the temperature rise in the apparatus, is performed. And when the transition condition control process, such as the temperature rise control process, is performed, the laser beam printer 100 is in the printing stand-by mode. However, when the transition condition is satisfied at step S500 (Y: step S500), the operation mode is transitioned to the power-saving mode (execute power-saving mode). Through the above described processing, product quality for the laser beam printer 100 is ensured, and the power consumed by the apparatus can be reduced.

As described above, the transition condition control at step S501 includes control of the temperature rise in the apparatus or control of the discharge of volatile organic compounds. Further, the control part 118 performs temperature counting to predict the temperature state, and changes the control for a fan based on the obtained temperature count value and a register counter value stored in advance (memory counter value). Then, the control part 118 performs the temperature rise control process or the volatile organic compound discharge control process. In this case, the fan is used to limit the rise in the temperature in the apparatus and to collect the volatile organic compounds. These fan control processes may be performed using a storage element or a thermoelectric transducer in order to provide greater power savings.

FIGS. 7A to 7D are diagrams for describing the relationship of a pre-heat threshold value of the fixing device 109, the temperature change in the fixing device 109 and the warm-up period. Specifically, FIG. 7A is a diagram illustrating a time-transient change in the state of the laser beam printer (apparatus) 100. FIG. 7B is a diagram illustrating a time-transient change in the electric power ([W]) consumed by the laser beam printer (apparatus) 100. FIG. 7C is a diagram illustrating a time-transient change in the temperature ([° C.]) of the fixing device 109. FIG. 7D is a diagram illustrating a time-transient change in the pre-heat ON and OFF states of the fixing device 109. Since the operation mode is transitioned to the power-saving mode by the process performed at step S302 to step S500 in FIG. 6, the stand-by period can be minimized, as illustrated in FIG. 7A. As a result, as illustrated in FIG. 7B, the apparatus power consumption can be reduced.

When a print job is received in the power-saving mode, multiple pre-rotations are performed. Since the warm-up operation is also required at this time, the user does not feel the period required for multiple pre-rotations is too long.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-123221, filed May 8, 2007, which is hereby incorporated by reference herein its entirety.

What is claimed is:

1. An image forming apparatus comprising:

an image forming part adapted to form an image on a recording material;

a heat fixing part including a heat source configured to generate heat from electrical power, for fixing the image formed on the recording material; and a controller configured to control the operation of the heat fixing part, wherein, the image forming apparatus is operable to transfer from a stand-by mode to a power-saving mode in which the electric power consumed by the image forming apparatus is smaller than the electric power consumed by the image forming apparatus in the stand-by mode, if the image forming apparatus does not receive a print job in the stand-by mode in a set time period, and the image forming apparatus further comprises:

a time period setting part configured to permit a user to set a time period for transferring to the power-saving mode, wherein, if the time period set by the user using the time period setting part is shorter than a reference period, the heat source is controlled to consume an average electric power in the stand-by mode which is smaller than the average electric power consumed if the time period set by the user is longer than said reference period.

2. An image forming apparatus according to claim 1, wherein, when the time period set using the time period setting part is shorter than the reference period, the heat source is controlled to consume zero electric power in the stand-by mode.

3. A method of reducing the power consumed by an image forming apparatus having a standby mode and a power saving mode which uses less power than the standby mode, the method comprising:

controlling the apparatus to enter the standby mode after switch on or after a job has been printed;

providing a predetermined threshold time period after which the apparatus is controlled to enter the power saving mode from the standby mode;

permitting a user to set a user defined mode transfer time period;

comparing the user defined mode transfer period with the predetermined threshold time period, and if the user defined mode transfer period is shorter than the predetermined threshold time period, controlling the image forming apparatus to consume less power in the standby mode.

* * * * *